United States Patent [19]

Rechberg

[11] Patent Number: 4,749,242

[45] Date of Patent: Jun. 7, 1988

[54] DRAWER SLIDE

[76] Inventor: Robert Rechberg, 3800 E. Miraloma Ave., Anaheim, Calif. 92806

[21] Appl. No.: 64,407

[22] Filed: Jun. 22, 1987

[51] Int. Cl.[4] ..... A47B 88/00

[52] U.S. Cl. ..... 312/333; 312/337; 312/348

[58] Field of Search ..... 312/333, 334, 337, 341 R, 312/348, 218; 384/18, 21

[56] References Cited

U.S. PATENT DOCUMENTS

| | | | |
|---|---|---|---|
| 1,557,765 | 10/1925 | Nicholas | 312/348 |
| 1,910,208 | 5/1933 | Gronberg et al. | 312/337 |
| 2,547,513 | 4/1951 | Wikman | 312/218 |
| 3,259,447 | 7/1966 | Deutsch | 312/348 |
| 3,401,998 | 9/1968 | Evans et al. | 312/218 |
| 3,801,166 | 4/1974 | York | 312/348 |
| 3,937,531 | 2/1976 | Hagen et al. | 312/348 |
| 4,067,632 | 1/1978 | Sekerich | 312/348 |
| 4,423,914 | 1/1984 | Vanderley | 312/348 |
| 4,441,772 | 4/1984 | Fielding et al. | 312/348 |
| 4,469,384 | 9/1984 | Fler et al. | 312/334 |

*Primary Examiner*—Victor N. Sakran
*Attorney, Agent, or Firm*—Stetina and Brunda

[57] ABSTRACT

A multi-member drawer slide automatically latches in both the fully extended end fully unextended positions. A largest, first, linear member is affixed to a cabinet; second and third intermediate linear members slide on ball bearings within the linear channel of next larger members; and a smallest, fourth, linear member slides frictionally within a linear channel of the third member and is affixed to a drawer. A latch frame affixed to the channel of the third member extends transversely to the members to a position exterior the first member's side. A pivot bar pivotably maintained on this latch frame selectively engages the first members's end, thereby holding the second and third members fully extended. In one embodiment this same pivot bar engages the first member's other end to maintain all members fully unextended. In another embodiment another latch is mounted to the first member's side and engages a fourth member end flange to hold all members fully unextended. A final latch retains the fourth member within the third member's channel.

15 Claims, 2 Drawing Sheets

FIRST END
SECOND END
FIRST END
SECOND END

DRAWER SLIDE

BACKGROUND OF THE INVENTION

The present invention generally concerns drawer slides, and particularly concerns sliding multi-member drawer slides which latch in both the extended and unextended positions.

It is known in the prior art to create drawer slides from a multiplicity of substantially linear metal members. Each metal member slides within the interior channel of a next successively larger member. By a succession of such members a drawer, or other object, which is supported for sliding motion by such members may be maintained in a first position within a cabinet when the members are unextended, or may be supported at a second position outside the cabinet when the slide members are extended.

The prior art drawer members make certain accommodations to their sliding and suspension function. They may be made of light alloy metals, and incorporate relieved areas, to reduce weight. The suspension between members may be by ball or roller bearings. A final one of the sliding members which attaches to a drawer, or other object, may be releasable and detachable from the other members so that the drawer may be completely extracted from its sliding suspension within a cabinet. Finally, it is known that drawer slides may be latched in both the extended and unextended positions.

In performing its function, a drawer slide should be strong, lightweight, compact, and durable. In performance of the latching function, the drawer slide should be positive acting with tactile feedback to a manual actuation, and should engage the slide members in both their unextended and extended positions in a strong and comprehensive manner prohibiting all movement among and between the members.

SUMMARY OF THE INVENTION

The present invention is embodied in a multi-member, sliding drawer slide which latches in both the extended and unextended positions. Two embodiments of drawer slides in accordance with the present are disclosed. Each embodiment particularly includes three linear members each of which members has first (front) and second (rear) ends and also has a longitudinal channel having first and second sides. Each successive one of the three linear members slides within the channel of a next larger one of the three linear members. Two of the members each slide from a first, unextended, position whereat its first end is adjacent to the first end of the next larger member's channel within which the member is retained, to a second, extended, position whereat the member's end extends beyond the first end of the next larger member.

Still a fourth linear member, having first and second ends, slides within the channel of a third member. Like the two other sliding members, this fourth member slides from an unextended position, whereat its first end is adjacent the third member's first end, to an extended position whereat it extends beyond, and indeed may be selectively removed from, the channel of the third member. By this nested construction a number of drawer slide members, nominally four in number, permit a considerable spatial sliding extension of a drawer, or chassis. Nominally the first and largest linear member is affixed to the sidewalls of the interior cavity of the cabinet, whereas the fourth and smallest linear member is affixed to the sidewalls of the drawer—but this can be reversed.

In accordance with a first embodiment of the present invention two positive-acting latch mechanisms selectively latch the nested drawer slide members in their respective unextended and extended positions. Particularly, a first latch is mounted to the exterior of the first member's channel's first side. This first latch has a pivot bar which selectively contacts or cooperates with the first ends of the first through fourth members in order to hold the sliding second through fourth members in their unextended positions. The latching function performed by the first latch pivot bar is aided by a first end flange formed upon the fourth linear member. This first end flange extends transversely from the fourth linear member across the third and second members' first ends to a position opposite the first member's first end. It is the latching of this fourth member flange by the first latch pivot bar which particularly retains all drawer slide members securely in their unextended positions.

Also in accordance with the first embodiment of the present invention, a second latch is provided for holding the sliding second through third members in their extended positions. This second latch has a frame which is mounted to the third member's channel and which extends to the exterior of the first member. This second latch also has a pivot bar which selectively engages the first member's first end in order to hold the second and third members in their extended positions. Both the pivot bar of the first latch and the pivot bar of second latch are biased (nominally by springs) to assume their latching positions, and are selectively manually actuable to release the drawer slide members for extension, or for retraction, as the case may be.

In a second embodiment of a drawer slide in accordance with the present invention, a single latch is employed to hold the drawer slide members, at separate times, in either their extended and unextended positions. The latch has a frame which is mounted proximate the second end of the third member's channel and which extends to the exterior of the first member. This mounting and extension is similar to the second latch within the first embodiment of the present invention. The latch has a pivot bar which alternatively selectively (i) engages the first member's first end to hold the second and third drawer slide members in their extended positions, or (ii) engages the first member's second end in order to hold all drawer slide members in their unextended positions. The latch is manually actuated for engagement by a connecting rod which extends to the front of the drawer, or chassis, which is suspended by the drawer slides. Therefore manual access to the latch for controlling it to hold the drawer slide members in either their extended or unextended positions is improved.

Each of the first and the second embodiments of drawer slides in accordance with the present invention may optionally incorporate a final latch which retains the fourth member within the channel of the third member. Release of this latch, which is possible only when the third member is extended, allows the fourth member (connected to the drawer) to be slid beyond, and to ultimately be completely withdrawn from, the third member's channel.

The drawer slides in accordance with the present invention are positive-acting in their sliding and latching, and are very strong. The latching in particular is performed by the engagement of major surfaces, and is approximately as strong as the drawer slide itself.

BRIEF DESCRIPTION OF THE DRAWINGS

These and other aspects of the present invention will become increasingly clear upon reference to the drawings wherein.

DESCRIPTION OF THE PREFERRED EMBODIMENT

Figures 1, 2, 3:
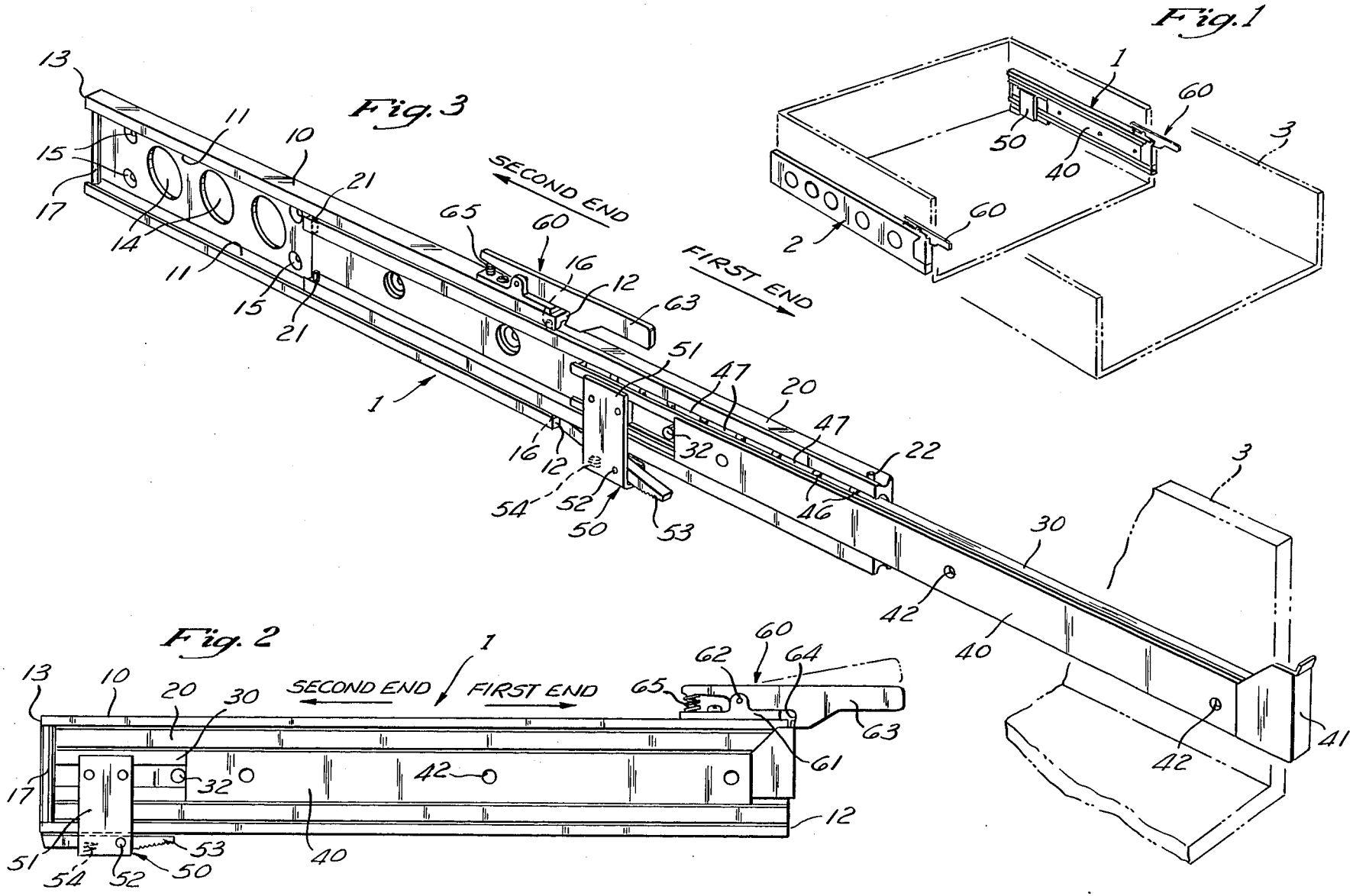
FIG. 1 is a perspective view showing a first embodiment of a right and of a left drawer slide in accordance with the present invention disposed in an operational environment.
FIG. 2 is a side view showing a first embodiment of an unextended right drawer slide in accordance with the present invention.
FIG. 3 is a perspective view showing a first embodiment of an extended right drawer slide in accordance with the present invention.

The present invention is embodied in a multi-member drawer slide which latches in both the extended and unextended positions. A first embodiment of a drawer slide in accordance with the present invention is generally shown in FIGS. 1-4. A first embodiment of a right drawer slide 1 and of a left drawer slide 2 are shown disposed in an operational environment supporting drawer 3 in FIG. 1. As may be observed, one side of each drawer slide 1, 2—nominally that side presented by member 40 (shown in FIG. 2 and FIG. 3)—is fastened to the drawer 3. The other side of each drawer slide 1, 2—nominally that side presented by first member 10 (shown in FIG. 2 and FIG. 3)—is fastened to a cabinet or other enclosure (not shown) which supports both drawer slides 1, 2 and the drawer 3. Drawer slides 1, 2 operate to allow the drawer 3 to be extended from its cabinet housing.

A side view of the preferred embodiment of a right drawer slide 1 in its unextended position, and a perspective view of the same right drawer slide 1 in its fully extended position, are respectively shown in FIG. 2 and FIG. 3. As will be recognized, the structure and function of both the right and left drawer slides is identical except for their reversed image orientations, and hence for purposes of description. The disclosure of the sides 1 and 2 will be described only in relation to the right drawer slide 1. The drawer slide 1 includes first, outermost, linear member 10; second and third intermediate, nested, linear members 20, 30; and fourth, innermost, nested, linear member 40. Each of the linear members 10, 20, 30 has an interior channel, for example interior channel 11 to member 10, within which the next smaller member slides. The last, fourth, member 40 fits within the channel of third member 30. Each of the sliding members 10, 20, 30, 40 has a first (front) and second (rear) end, for example, first end 12 and second end 13 to member 10. When the members 20, 30, 40 are disposed in their unextended positions, as illustrated in FIG. 2, then the first ends of each member are aligned, and are proximate to each other. When the members 20, 30 are disposed in their extended positions, as illustrated in FIG. 3, then the first end of member 20 extends beyond the first end 12 of member 10, and likewise the first end of member 30 extends beyond the first end of member 20. Member 40 is shown unextended from the channel of member 30 in FIG. 3.

Figure 4:
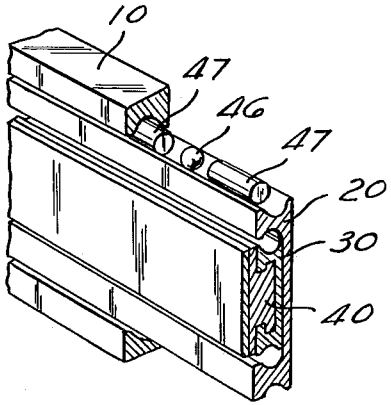
FIG. 4 is a perspective view, partially in cross section, particularly showing the bearing suspension within the first embodiment of a right drawer slide in accordance with the present invention.

The detailed structure of the linear members 10, 20, 30, 40, and their suspension one to the next, is best illustrated in FIGS. 2, 3 and 4. The first member 10 is possessed of relieved areas, or holes, 14 in order to reduce weight. It has a plurality of countersunk holes 15 in order that it may be mounted to a cabinet by countersunk screws or bolts in a manner which allows member 20 to slide without obstruction within channel 11.

The interior side edges to channel 11 of member 10, and the exterior side edges of member 20, jointly define a bearing raceway. Within this bearing raceway are positioned steel ball bearings 50, and teflon bearing spacers 51, as is best observed in FIG. 4. The total linear extent of the bearings 50, and bearing spacers 51, are such that they fit tightly within the bearing raceway, and between the first end 12 to member 10 and the second end to member 20, when the member 20 is fully extended as illustrated in FIG. 3. The bearings 50 and bearing spacers 51 are maintained within the bearing raceway between pins 21 which extend into the bearing raceway at the second end of member 20, and pins 16 which extend into the same bearing raceway at the first end of member 10. Similarly, there is a pin 22 at the first end of member 20 which extends into the bearing raceway between the member 20 and the member 30, and a pin 31 at the second end of member 30 which extends into this same raceway. Within this bearing raceway between members 20 and 30 are additional bearings 50 and bearing spacers 51, as may again be observed in FIGS. 3 and 4. These bearings 50 and bearing spacers 51 are retained within the raceway by pins 22 and 31 extending into the raceway.

The fourth member 40 is not suspended by bearings within the channel of linear member 30; rather it simply slides within this channel. The member 40 could be stopped in the extent of its maximum entrance into the channel of member 30 by its first end flange 41. However, in order to reduce the considerable stress upon this flange which may occur when a heavy drawer, or chassis, which is mounted to holes 42 of member 40 is slid inwards, thereby forcing member 40 powerfully down the channel of member 30, a stop to member 40 is provided by pin 32 within the channel of member 30.

The relative suspension of the members 10, 20, 30 and 40 permits their sliding movement, each one to the next, between a first, unextended, position and a second, extended, position. The bidirectional movement of member 20 relative to member 10, and of member 30 relative to member 20, and the movement in a one (inwards) direction of member 40 relative to member 30, is constrained even without the action of latches. To repeat, latches 50, 60, 70 which are within the drawer slide 1 in accordance with the present invention are not necessary to hold the drawer slide 1 together in operative configuration. Particularly, members 20, 30 are restrained in their fully unextended positions, and are restrained from exiting the second end of member 10, by post 17 across the channel 11 of member 10. Member 40 is restrained for movement in this same second end direction by the pin 32 within the channel of member 30. Meanwhile, member 20 is restrained from being extracted from the first end of the channel 11 of member 10 jointly by the bearings 50 and bearings spacers 51 which are captured in the raceway between such members. The member 30 is similarly prevented from being extracted from the first end of member 20. Therefore, and prior to discussion of the latches of the drawer slide 1 in accordance with the present invention, it should be understood that the members of such drawer slide 1 are basically constrained in the extent of their individual and collective sliding to unextended and extended positions even without the action of latches.

The latches 50, 60, 70 within the drawer slide 1 in accordance with the present invention engage automatically under spring force when the members 10, 20, 30, 40 are in their fully unextended, or fully extended, alignments or positions. When engaged, the latches 50, 60, 70 can absorb great force: force which is commensurate with what the drawer slide 1 can itself withstand. This is important when the suspended drawer is heavy and/or must be protected against inadvertent movement from either the fully housed (unextended drawer slide 1) or fully extended positions. The suspension of certain electronics chassis, ruggedized drawer slide applications, and militarized drawer slide applications are examples of requirements for drawer slides which provide strong positive positional control. This strong positional control is so provided by drawer slides in accordance with the present invention.

The latches 50, 60, 70 within the drawer slide 1 in accordance with the present invention are respectively for (i) holding members 20, 30 in the fully extended positions, (ii) holding all members 10, 20, 30, 40 in the unextended position, and (iii) holding member 40 in its unextended position within the channel of member 30. Particularly, the location, structure, and function of latches 50 and 70 are common within both embodiments of the present invention.

In the first embodiment of the drawer slide 1 of the present invention shown in FIGS. 1–4, latch 50 comprises a frame 51 which is mounted to the channel of member 30 proximate the second end of member 30. This frame 51 extends to the exterior side of the channel 11 of the first member 10. This extension can be to either exterior side of the channel. The extension of frame 51 is illustrated to be to the bottom exterior side of channel 11 in that first embodiment shown in FIGS. 1–4, and is illustrated to be to the top exterior side of channel 11 in that second embodiment shown in FIGS. 5 and 6. At its furthest extension from its mounting point within the channel of member 30 the frame 51 defines a pivot axis, or pivot pin, 52.

A pivot bar 53 pivots about this pivot axis 52. The pivot bar 53 assumes an engaged first position wherein it abuts the first end 12 to member 10 when both the members 20, 30 are fully extended. The pivot bar 53 is biased to assume its first, engaged, position by a spring 54 located between the frame 51 and the pivot bar 53. When the pivot bar 53 and the latch 50 is so spring biased, then the pivot bar 53 will automatically assume its engaged first position upon such times as members 20 and 30 are fully extended. In order to release this engaged first position, and in order to allow the return of members 20, 30 from their fully extended positions, a manual pressure is applied to the first end of pivot bar 53 toward the members thereby causing disengagement of the second end of the pivot bar 53 from its abutted position against the first end 12 to member 10. If, after this momentary release of latch 50, the pivot bar 53 is then allowed to reassume, under spring force, contact with the exterior side of channel 11 to member 10, then this contact only means that the second end of pivot bar 53 will slide along the exterior side of member 10 without difficulty until it, and the entire latch 50, ultimately assume the position shown in FIG. 2.

Another latch 60 employed within the drawer slide 1 in accordance with the present invention is used to selectively retain sliding members 20, 30, 40 in their unextended positions. This latch 60 is mounted to the exterior side of channel 11 of first frame member 10 on the opposite side to latch 50. This latch 60 has a latch frame 61 which is mounted to the exterior side (of the channel 11) of linear member 10 near the first end 12 of this linear member 10. The latch frame 61 supports a pivot axis, or pin, 62. A pivot bar 63 is supported for pivoting upon the pivot axis 62. The pivot bar 63 presents a hook or shoulder upon its first end which is disposed to one side of the pivot axis 62. This hook or shoulder 64 of the pivot bar 63 assumes a first, engaged, position which is illustrated in solid line in FIG. 2. It may be momentarily manually moved to a second, disengaged position which is illustrated by dashed line in FIG. 2. Finally, the pivot bar 63 may return to its initial first position as illustrated in FIG. 3.

Particularly, the hook 64 of the pivot bar 63 of the latch 60 is operative to engage, and abut, the first ends of the sliding members 20, 30, 40 only when such members are within their fully unextended positions. To do so, the hook 64 itself extends downwardly through a short distance only so far so as to fall only over the first end 12 to member 10 at a slight seperation therefrom. The hook 64 does not extend so far so as to interfere with the extension of sliding member 20 (and sliding member 30) which is illustrated in FIG. 3. Accordingly in order to affect a latching retention of sliding members 20, 30, the hook 64 of pivot bar 63 of latch 60 needs to be, and is, interactive with flange 41 to member 40. This first end flange 41 to member 40 extends transversly from the member 40 across the first end side of third member 30, across the first end side of second member 20, and to a position opposite the first end side 12 of first member 10. At this point the flange 41 of the fourth member 40 may be engaged by the hook 64 of pivot bar 63 as shown in FIG. 2. Since the flange 41 overlays the first end of all sliding members 20, 30, 40, the entire drawer slide 1 is latched by latch 60 in its fully unextended position.

The pivot bar 63 to latch 60 is preferably, optionally, biased to assume its engaged first and unengaged third positions. This bias is preferably accomplished by a spring 65 which is positioned between the frame 61 and a second end of pivot bar 63. The spring 65 exerts an expansion force which tends to force the pivot bar 63 to that position which is illustrated in solid line in both FIGS. 2 and 3. In order to disengage the pivot bar 63 from this latching position, it may be grasped between the fingers at its first end and manually lifted.

The latches 50, 60 to drawer guide 1 in accordance with the present invention are thus seen to secure and latch the sliding members in their fully unextended and their fully extended positions automatically during movement of the members respectively assuming their unextended or extended positions. This is called "positive-acting" or "positive latching". The latches 50, 60 are manually releasable from their holding engagement. Particularly, both latches 50, 60 are released by a force which is exerted in the same direction. This is true even though the pivot bar member 53 to latch 50 is depressed toward the sliding members 20, 30, 40 by its first end whereas the pivot bar 63 to latch 60 is lifted away from these same sliding members 20, 30, 40 by its first end. Further analysis of the forces, and the direction of such forces, involved in the operation drawer guide 1 in accordance with the present invention will be obvious to a practitioner of the mechanical arts.

Figure 5:
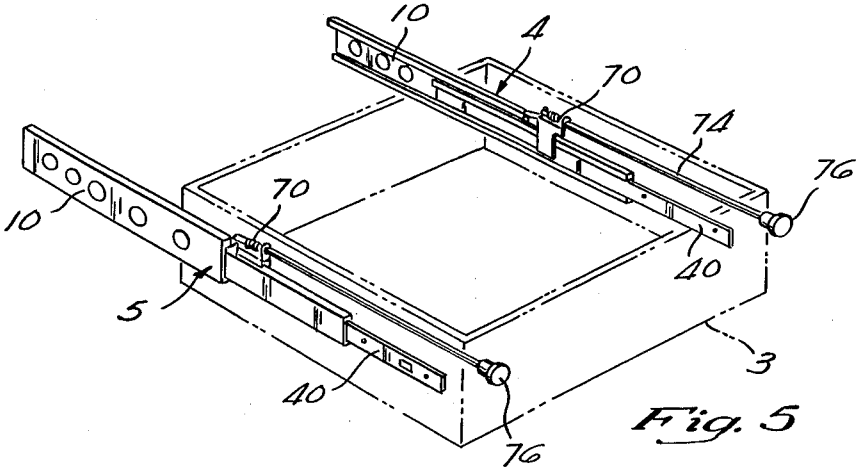
FIG. 5 is a perspective view, showing a second embodiment of a right and of a left drawer slide in accordance with the present invention disposed in an operational environment.
Figure 6:
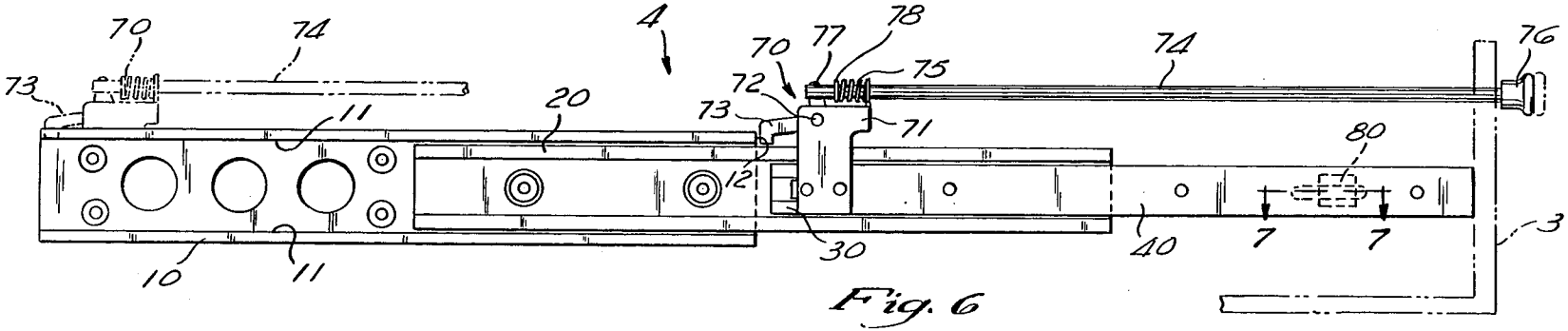
FIG. 6 is a side view of a second embodiment of an extended right drawer slide in accordance with the present invention.

A second embodiment of a right drawer slide 4, and of a left drawer slide 5, in accordance with the present invention are illustrated in deployed position in FIG. 5 which is similar to the illustration of drawer slides 1, 2 in FIG. 1. Similar to the drawer slides 1, 2, each of the drawer slides 4, 5, employs linear members 10, 20, 30, 40. These members are retained for sliding within the channels of one another just as they are within the first embodiment of the drawer slides 1, 2. The second embodiment of the drawer slides 4, 5 employ only one latch 70 to perform the function of both latches 50 and 60 in the first embodiment of the drawer slides 1, 2 in accordance with the present invention. This latch 70 is seen in side view in FIG. 6 which shows the second embodiment of a right drawer slide 4.

The latch 70 has a frame 71 which is mounted to the channel of the third member 30 proximate its second end, and which extends transversely from this channel mounting to the exterior side of the channel of the first member 10; both this mounting and extension being similar to latch 50 in the first embodiment drawer guide 1, 2 in accordance with the present invention. The latch 70 also includes a pivot axis, or pin, 72 and a pivot bar 73 pivoting about the pivot axis. Control of the position of the pivot bar 73 is by pull rod 74 which connects by a pinned joint 77 to the first end of the pivot bar 73. This rod 74 extends a sufficient axial distance so that it's distal end is positioned adjacent to the front of drawer, or chassis, 3 at all extension positions of the second embodiment drawer slides 4, 5. The position of rod 74, and of pivot bar 73 to which it connects, is biased by the force provided by spring 75. The spring 75 acts between frame 71 and a retainer 78 near the second end of pull rod 74 to push this rod toward the second end and to cause the pivot bar 73 to press inwardly toward the channel 11 of member 10. When the sliding members 20, 30 are fully extended then this biasing force will force pivot bar 73 into the position illustrated in solid line in FIG. 6 whereat it will engage or about the first end 12 of the first member 10.

In order to release the pivot bar 73 against the force of spring 75 from this engaged first position, the knob 76 to rod 74 is momentarily pulled simultaneously to the drawer 3 being pushed inward, thereby causing the sliding members 20, 30 to move inwardly from their fully extended positions. After this occurrance, the pivot bar 73 will assume an unengaged second position (not illustrated) which is against the exterior side of the channel 11 of first member 10. At this position the pivot bar 73 will slide along the exterior side of the channel of first member 10, and will not interfere with the sliding motion of any drawer member.

When each of the drawer members 20, 30, 40 is in its fully unextended, i.e. contracted, position, then the latch 70, and the pivot arm member 73 thereof, will be in a position at the second end of all members. At this position the hook of the pivot member 73 will fall over, and engage, the second end of first member 10. In this engaged third position hooking the second end of first member 10, the pivot bar 73 will hold each of the sliding member 20, 30 40 in their unextended positions. Thus a single latch 70 serves to latch the sliding members 20, 30 in both their extended, and unextended positions.

Figure 7:
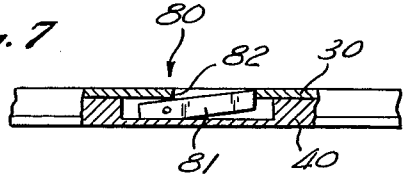
FIG. 7 is a detail cross-sectional view particularly showing a latch between a third and a fourth member of each embodiment drawer slide in accordance with the present invention.

Still another latch, optionally used in both the first and the second embodiments of the present invention, is shown in FIG. 7. The latch 80 shown therein is located between the third member 30 and the fourth member 40. It is nominally located along the length of such substantially linear members approximately at location of aspect line 7—7 shown in FIG. 6, but may be located anywheres between the overlapping structure of the members. The latch 80 operates by a spring-loaded wedge 81 which is pin mounted to either one of the third member 30 or the fourth member 40. The spring-loaded wedge 81 engages a cavity 82 formed in the other one of the linear members from that member within which it is mounted. In the preferred embodiment illustrated in FIG. 7, the spring-loaded wedge 81 is within, and mounted by pinning to, the fourth member 40, whereas the cavity 82 is within the side of third member 30. The wedging surface of spring-loaded wedge 81 is substantially a flat chisel surface, and the cavity 82 is normally square in shape presenting a flat opposing wall to this chisel surface.

The latch 80 is illustrated in its engaged position within FIG. 7. In this position it retains the fourth linear member 40 within its unextended position within the third linear member 30. The spring-loaded wedge 81 may be depressed by reaching with a fingertip through orifice 82 and momentarily pushing such spring-loaded member from contact with the sidewall of orifice 82 simultaneously that linear member 40 is withdrawn, or extended, from linear member 30. After this manual release, the spring-loaded wedge 81 assumes and maintains an unengaged position sliding along the interior channel of linear member 30. This unengaged position allows the fourth member 40 to slide to an extended position protruding from member 30, and to further slide to a superextended position wherein it may be completely withdrawn from member 30. Therefore, the latch 80 in accordance with the present invention provides that the entire drawer or chassis, 3 may be totally withdrawn from either the first embodiment drawer slides 1, 2 or the second embodiment drawer slides 4, 5 within which it is mounted.

In accordance with the preceding discussion the present invention has been seen to incorporate diverse aspects concerning the detailed construction and interrelationship of members within a sliding drawer slide, and concerning the latches controlling the extension of such members. Consider the manner in which the latch 50 within the first embodiment of the present invention operates equivalently to the latch 70 within the second embodiment of the present invention even though they are oppositely disposed. It is obviously possible for one having ordinary skill in the art of mechanical design to relocate certain of the latch elements, and their engagement surfaces, within the drawer slide apparatus of the present invention without departing from the true scope and spirit of the invention. For example, if the design of the enclosing cabinet permits, then the hooking action of latch 60 (visible in FIGS. 2 and 3) could be performed from the large, flat, rear exterior side—and not from the top or bottom exterior sides—of channel 11 to outer member 10. In such position the latch 60 would be disposed to the side of member 10 the latch 60. However, it would still engage the flange 41 at the end of fourth linear member 40. Further, those skilled in the art will recognize that each of the latch mechanisms disclosed herein can be utilized separately or in combination with one another to facilitate latching either in the extended, unextended, or both extended and unextended positins of the drawer slides. Corresponding to such obvious alterations, the present invention should be interpreted in accordance with the language of the following claims, only, and not solely in accordance with those two preferred embodiments within which the present invention has been taught.

What is claimed is:

1. A drawer slide comprising:

a first and a second and a third linear member, each having (i) first and second ends and (ii) an elongated channel;

wherein the second member is slidingly received within the channel of the first member from an to an extended position whereat the second member's first end extends beyond the first member and its channel;

wherein the third member is slidingly received within the channel of the second member from an unextended position whereat the third member's first end is adjacent the second member's first end to an extended position whereat the third member's first end extends beyond the second member and its channel;

a fourth linear member slidingly received within the channel of the third member from an unextended position whereat the fourth member's first end is adjacent the third member's first end to an extended position whereat the fourth member's first end extends beyound the third member and its channel and further, to a superextended position where the fourth member is extractable from the third member's channel; and a latch comprising:

a frame mounted to the third member's channel proximate the third member's second end and extending to the exterior of a side of the first member's channel;

a pivot axis supported by the frame;

a pivot bar pivoting about the pivot axis;

wherein the pivot bar assumes an engaged first position contacting the first member's first end in order to hold the second and third members in their extended positions;

wherein the pivot bar assumes an unengaged second position exterior to the side of the first member's channel; and a second latch, mounted to the exterior of the first member's channel, having a pivot bar selectively engaging the first ends of the first through fourth members to hold the second through fourth members in their unextended positions.

2. The drawer slide according to claim 1 wherein the fourth member comprises:

a first end flange extending from a central location at the first end of the member transversely across a portion of the third member's first end, across a portion of the second member's first end, and to a position opposite a portion of the first member's first end; and wherein the second latch pivot bar selectively engages the first ends of the first through fourth members by contacting the fourth linear member's flange.

3. The drawer slide according to claim 1 wherein the second latch comprises:

a pivot axle for the pivot bar;

a spring between the pivot bar and the first member for biasing with spring force the pivot bar to engage, at a point along this pivot bar, the first ends of the first through fourth members.

4. The drawer slide according to claim 1 wherein the third member and the fourth member collectively comprise:

a spring-loaded wedge mounted to one of the third or fourth members and engaging a cavity within the other one of the third or fourth members;

wherein the spring-loaded wedge assumes an engaged position retaining the fourth member at its unextended position;

wherein the spring-loaded wedge assumes an unengaged position to allow the fourth member to slide to its extended position.

5. The drawer slide according to claim 4 wherein the spring-loaded wedge is mounted to the fourth member and wherein the cavity is within the third member.

6. The drawer slide according to claim 1 wherein the second latch includes:

a spring for biasing the pivot bar for selectively hooking.

7. An apparatus for selectively latching a multi-member nested-member drawer slide fully closed and unextended and fully open and extended, the apparatus comprising:

a flange mounted upon a first end of an innermost nested member of the drawer slide, the flange extending transversely to the slide and past the ends of intermediate nested members of the drawer slide to terminate in a flange end which is positioned opposite a first end of an outermost member of the multi-member drawer slide;

a first latch comprising:

a latch frame mounted at the exterior of the outermost member near its first end;

a pivot axis supported by the latch frame;

a pivot bar pivoting upon the pivot axis;

a hook upon an end of the pivot bar upon a first side of the pivot axis;

a spring upon the second side of the pivot axis for spring biasing the pivoting motion of the pivot bar about the pivot axis;

wherein the pivot bar hook is biased by the spring to, upon such times as the flange is positioned closely opposite the outermost member's first end, extend over the first end of the outermost member sufficiently far so as to latch the innermost member flange and thereby maintain all of the multiple nested members in their closed and unextended positions and prevented from sliding extension;

wherein the pivot bar is adapted to be manually pivoted against the spring bias so that the pivot bar hook does not extend over the first end of the outermost member.sufficiently far so as to latch the innermost member flange; and a second latch comprising:

a latch frame mounted to the second innermost member near its second end and extending transversely from this member to a position beyond the exterior of the outermost member;

a pivot axis supported by the latch frame at a position beyond the exterior of the outermost member;

a pivot bar pivoting upon the pivot axis;

a spring upon a first side of the pivot axis for spring biasing the pivoting motion of the pivot bar about the pivot axis;

wherein the end of the pivot bar upon the first side of the pivot axis is biased by the spring to scape along the exterior of the first member until, and unless, all members save the innermost are fully extended, the pivot bar then being biased by the spring to a position wedging against the first end of the outermost member, thereby latching all members save the innermost in said fully extended position.

8. A drawer slide comprising:

three, first and second and third, linear members each having (i) first and second ends and (ii) a channel;

wherein the second member is sliding within the channel of the first member to an extended position beyond the first member's first end;

wherein the third member is sliding within the channel of the second member to an extended position beyond the third member's first end; p1 a fourth linear member having first and second ends;

wherein the fourth member is sliding within the channel of the third member to an extended position beyond the third member;

a first latch comprising:

a frame mounted to the third member's channel proximate the third member's second end and extending to the exterior of a side of the first member's channel, thereby this mounting precluding that the fourth member should slide beyond the third member's second end;

a pivot axis supported by the frame; and a pivot bar pivoting about the pivot axis;

wherein the pivot bar assumes an engaged first position wedging the first member's first end in order to hold the second end third members in their extended positions;

wherein the pivot bar assumes an unengaged second position exterior to the side of the first member's channel;

wherein the pivot bar assumes an engaged third position hooking the first member's third end in order to hold the second member unextended within the third member's channel and also the second member unextended within the first member's channel; and a second latch comprising:

a spring-loaded wedge mounted to a one of the third or the fourth member at a position between then; and a cavity defined by and within the other one of the third or the fourth members;

wherein the spring-loaded wedge assumes an engaged first position wedging a wall of the cavity in order to hold the fourth member unextended within the third member's channel;

wherein the spring-loaded wedge assumes an unengaged second position allowing the fourth member to slide within the channel of the third member.

9. A drawer slide comprising:

a first linear member having and defining (i) first and second ends, and (ii) a channel having first and second sides, each side having an exterior wall and an interior wall which is adapted for a bearing raceway;

a second linear member having and defining (i) first and second ends, and (ii) a channel having first and second sides, each side having an exterior wall which is adapted for a bearing raceway and an interior wall which is adapted for a bearing raceway;

first bearings retained between the first member's channel's first side's interior wall and the second member's channel's first side's exterior wall, and also between the first member's channel's second side's interior wall and the second member's channel's second side's exterior wall;

wherein the second member may slide by bearing suspension within the first member's channel from an unextended position whereat the second member's first end is proximate to the first member's first end, to an extended position whereat the second member's first end extends outside of the first member's channel and beyond the first member's first end;

a third linear member having and defining (i) first and second ends, and (ii) a channel having first and second sides, each side having an exterior wall which is adapted for a bearing raceway and an interior wall presenting a first sliding engagement surface;

second bearings retained between the second member's channel's first side's interior wall and the third member's channel's first side's exterior wall, and also between the second member's channel's second side's interior wall and the third member's channel's second side's exterior wall;

wherein the third member may slide by bearing suspension within the second member's channel from an unextended position whereat the third member's first end is proximate to the second member's first end, to an extended position whereat the third member's first end extends outside of the second member's channel and beyond the second member's first end;

a fourth linear member having and defining (i) first and second ends, (ii) exterior sides having second sliding engagement surfaces which are complementary with the third member's channel's side's interior wall first sliding engagement surfaces, and (iii) a first end flange extending transversely from the member to a position overlapping the third member's channel's first side's first end, further overlapping the second member's channel's first side's first end, and further overlapping the first member's channel's first side's first end;

wherein the fourth member may slide within the third member's channel from an unextended position whereat the fourth member's first end flange is proximate to the third member's first end and also to the second member's first end and also to the first member's first end, to an extended position whereat the fourth member is withdrawn from the third member's channel;

a first latch, mounted to the first member's channel first exterior wall proximate the first member's first end, having a latch portion which IF the fourth member is in its unextended position within the third member's channel AND the third member is in its unextended position within the second member's channel AND the second member is in its unextended position within the first member's channel THEN the latch portion engages the fourth member's first end flange and retains all members in their respective unextended positions, ELSE IF the fourth member's first end flange is not proximate the first member's first end because one or more of the fourth, third, and second members are not within their respective unextended positions THEN the latch portion engages nothing and does not interfere with the sliding of any member;

a second latch, mounted to the third member's channel proximate the third member's second end, having a latch portion which IF the third member is in its extended position within the second member's channel AND the second member is in its extended position within the first member's channel THEN the latch portion engages the first member's channel's second wall's first end and retains the third and second members in their respective extended positions while not affecting the fourth member, ELSE IF either or both of the third and second members are not within their respective extended positions THEN the latch portion engages nothing and does not interfere with the sliding of any member.

10. The drawer slide according to claim 9 wherein the first latch further comprises:

a spring biasing the latch portion to its position engaging the fourth member's first end flange.

11. The drawer slide according to claim 9 wherein the first latch further comprises:

a pivot upon the first member's channel's first side exterior wall proximate the first member's first end;

a lever arm extending about the pivot and having a first end and having a second end hook directed toward the first member at a position along the first member which extends beyond the first member's first end;

a spring between the first member's channel first exterior wall and the lever arm first end for exerting an expansion force causing the lever arm second end hook to fall over the first member's channel's first side first end therein engaging the fourth member's first end flange.

12. The drawer slide according to claim 11 wherein the first latch lever arm first end further comprises:

an extension adapted for grasping by the fingers for movement in a direction transversely away from the first member, therein releasing the second end hook engagement of the fourth member's first end flange.

13. The drawer slide according to claim 9 wherein the second latch comprises:

a spring biasing the latch portion to its engaging the first member's channel's second wall's first end.

14. The drawer slide according to claim 9 wherein the second latch comprises:

a stanchion mounted to the third member's channel and extending transversely to this channel to a position beyond the first member's channel's second side's exterior wall;

an axle shaft affixed to the stanchion;

a lever arm having a first end and a second end, and pivoting upon the axle shaft; and a spring between the stanchion and the lever arm for exerting an expansion force causing the lever arm second end to engage the first member's channel's second wall's first end.

15. The drawer slide according to claim 14 wherein the second latch lever arm first end comprises:

an extension adapted for pushing by the fingers for movement in a direction transversely toward the first member therein releasing the lever arm's second end engagement of the first member's channel's second wall's first end.

* * * * *